US009055619B1

(12) United States Patent
Cavolina

(10) Patent No.: US 9,055,619 B1
(45) Date of Patent: Jun. 9, 2015

(54) TOROIDAL TRANSFORMER TRANSISTOR DRIVER FOR ELECTRICAL BALLAST

(76) Inventor: Alejandro Cavolina, Miami, FL (US)

( * ) Notice: Subject to any disclaimer, the term of this patent is extended or adjusted under 35 U.S.C. 154(b) by 581 days.

(21) Appl. No.: 13/155,588

(22) Filed: Jun. 8, 2011

(51) Int. Cl.
*H05B 37/00* (2006.01)

(52) U.S. Cl.
CPC ..... *H05B 37/00* (2013.01)

(58) Field of Classification Search
USPC ..... 315/246, 266, 267, 291
See application file for complete search history.

(56) References Cited

U.S. PATENT DOCUMENTS 5,448,137 A * 9/1995 Bobel ..... 315/244
2002/0121948 A1* 9/2002 Giday et al. ..... 335/18

* cited by examiner

*Primary Examiner* — Douglas W Owens
*Assistant Examiner* — Jonathan Cooper
(74) *Attorney, Agent, or Firm* — Jesus Sanchelima; Christian Sanchelima

(57) ABSTRACT

An electrical ballast system having a toroidal current transformer having a core with a gap of predetermined dimensions, a primary winding, and a secondary winding. The primary winding is connected in series to a lamp load circuit and the secondary winding is connected to a transistor driver having an input. The improvement comprises the reduction of the effective area of the transformer core a sufficient amount to limit the output voltage amplitude of the secondary winding within a predetermined range compatible with the input of the transistor driver. The reduction of the effective area of the core is achieved with a cut or gap that covers up to 75% of the effective cross-sectional area. The resulting transformer will operate linearly for low load currents passing through the lamp and primary. For load currents above a predetermined magnitude, the core is saturated and additional magnetic flux lines pass through the gap, attenuated. The waveform of the current through the primary is thus kept in the secondary, attenuated, thereby protecting the transistors' inputs connected to the secondary.

6 Claims, 8 Drawing Sheets

TOROIDAL TRANSFORMER TRANSISTOR DRIVER FOR ELECTRICAL BALLAST

BACKGROUND OF THE INVENTION

1. Field of the Invention

The present invention relates to a toroidal current transformer transistor driver, and more particularly, to a toroidal current transformer transistor driver for an electrical ballast for non-lineal limitations from large current variations in primary.

2. Description of the Related Art

Several designs for toroidal current transformer transistor drivers have been designed in the past. In most ballast systems, different approaches are used to drive half bridge or H bridge transistors. One of these approaches involves the use of a toroidal current transformer to drive transistors. The problem arises where the voltage induced in the secondary of a toroidal current transformer fluctuates over an extremely large range. Therefore, the use of toroidal current transformers, without the use of complicated correcting ICs, has been limited to low power ballasts or medium power with stabilized DC source. It has been found that there are differences in current amplitude of 5-7 times (minimum amplitude with respect to maximum amplitude). To protect the gates of the transistors being driven, resistors and zener diodes are used, in addition to other current/voltage limiting circuitry. The energy dissipated by these resistors and zener diodes is wasted and, not infrequently, the generated heat adversely affects the operation of the ballast circuit. Thus, the desirability of limiting the wasted energy to drive the transistors is quite evident.

The current through a ballast's load, typically a halide lamp, is not constantly causing variations in the voltage induced in the secondary of a toroidal current transformer connected to the transistor's gates. These gates require between 12 and 15 volts. Therefore, the number of turns in the secondary need to ensure at least 12 volts output. But when the load current increases seven to ten times the lowest intensity (capable of still driving the transistors), a corresponding secondary voltage increase follows, requiring the usage of limiting voltage elements, such as zener diodes and resistors, to protect the transistor's gates. The resulting heat is wasted energy that tends to adversely affect the operation of the rest of the circuit and shortens its life. Thus, there is a need to find a self-limiting device that is passive to minimize costs and extend the life of the ballast without wasting electrical energy.

One approach in the construction of ballasts is to use circuits with passive valley fill, such as the one commercialized by International Rectifier (El Segundo, Calif.) under part No. IR 2156 and explained in application note AN-1074. The advantage of the IR circuit is that it provides a stable output in the secondary with variation in the load current. However, the use of integrated circuits is expensive and not reliable, especially for high power lamps. The relatively high temperatures to which the ballasts are exposed diminish the life of the IC whereas passive elements, such as a toroidal transformer, have considerably longer lives. To improve this IR IC solution, the present invention provides a passive circuit for limiting the voltage output while variations of the load (lamp) current is used as the primary of the toroidal current transformer.

Other documents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a transistor driver for electrical ballasts that includes a non-linear limitation of the voltage applied to the transistors' gates.

It is another object of this invention to provide a transistor driver for electrical ballasts where such non-linear limitation is accomplished with a passive element.

It is still another object of this invention to provide a ballast circuit that can operate at high temperatures with a relatively long life and capable of withstanding noise and other transitory voltage disturbances without being damaged.

Another object of the invention is to provide a ballast circuit with a valley fill circuit that minimizes the soldering requirements for sensitive active components.

It is yet another object of this invention to provide such a circuit that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
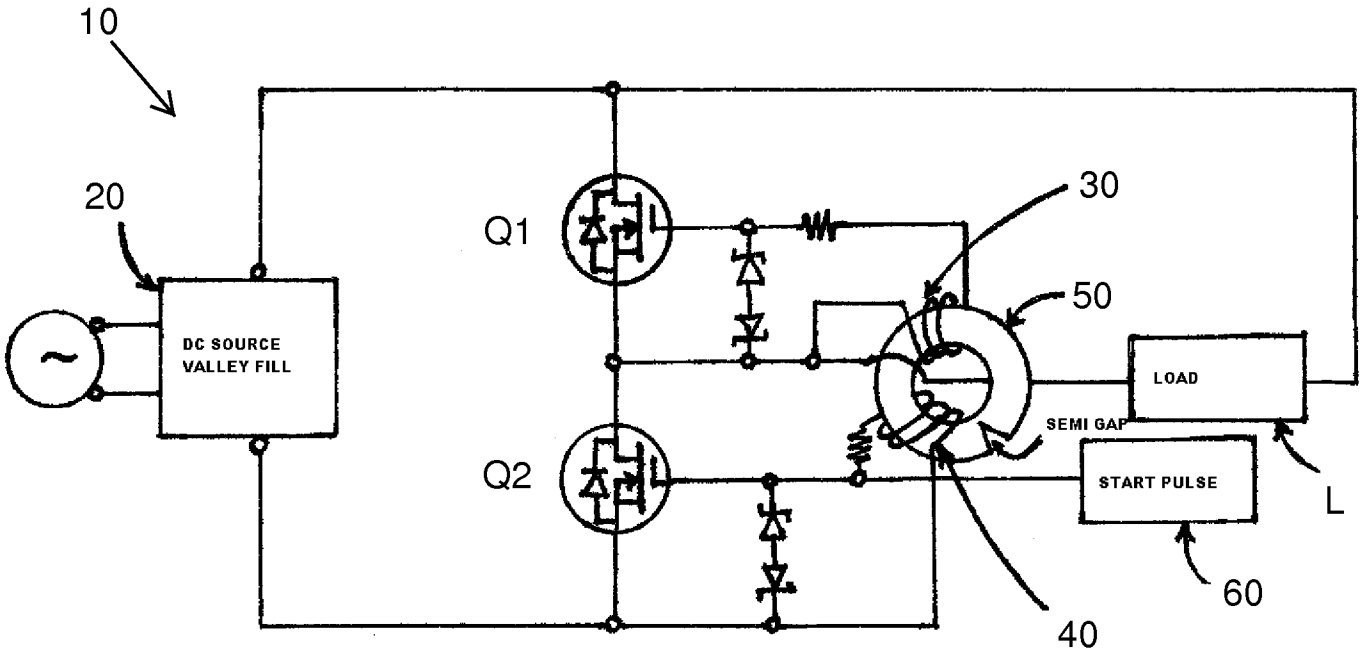
FIG. 1 represents a circuit for a half bridge self-resonant transistor driver incorporating a toroidal current transformer with a partial cutout in accordance with the present invention.
Figure 1A:
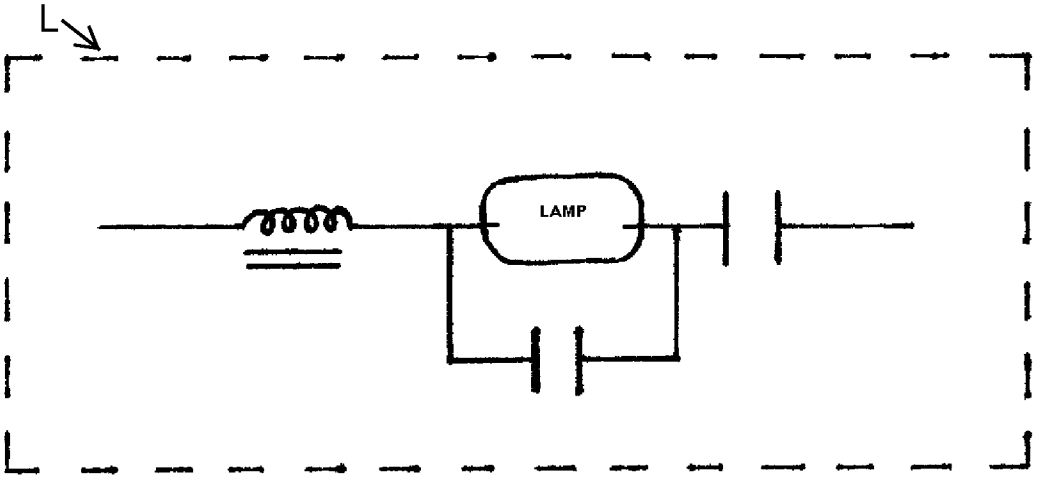
FIG. 1A is a schematic representation of a load circuit, which includes a lamp.

Referring now to the drawings, where the present invention is generally referred to with numeral 10, it can be observed that it basically includes a half bridge transistor driver self-resonant circuit, including a toroidal current transformer with a gap having predetermined dimensions related to the area of the transformer's toroidal core. The purpose of the gap is to set the saturation of the toroidal current transformer at a predetermined magnetic flux by providing a portion of the toroidal core cross-section with a high permeability and the rest of the core cross-section having a relatively low permeability (air gap).

In FIG. 1, a half bridge transistor driver resonant circuit is represented in accordance with the present invention wherein a rippled DC source 20 is connected to a lamp load circuit L in series with the primary of a toroidal transformer. This primary is simply a wire that passes through the toroidal hole. The gates of transistors Q1 and Q2 are connected through limiting resistors and zeners, to secondary windings 30 and 40. Transformer 50 has a toroidal core with a gap or cut to be described below. Start pulse circuit 60 is of the conventional type for ballasts for self-resonant inverters and the like.

Figure 2:
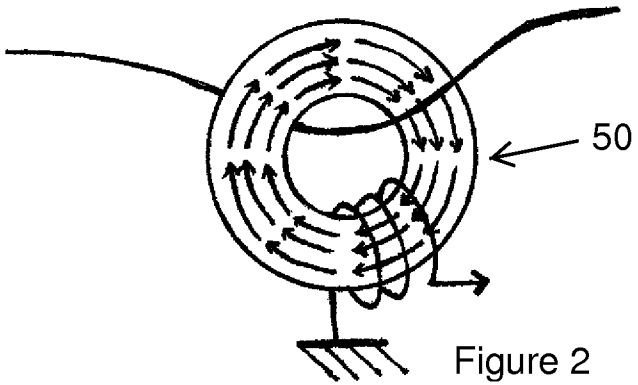
FIG. 2 shows a conventional toroidal current transformer used in a valley fill circuit with a high current load (up to ten times the minimum) and a representation of magnetic flux lines in a non-saturated core.
Figure 2A:
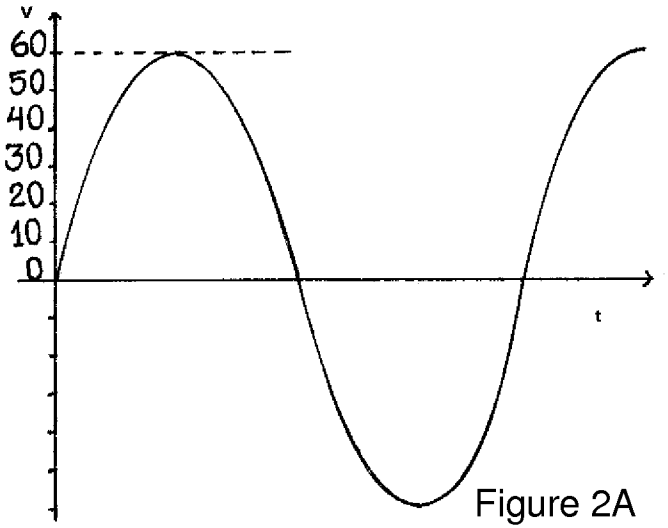
FIG. 2A is a Cartesian chart showing the resulting waveform of the voltage output in the secondary shown in FIG. 2.
Figure 3:
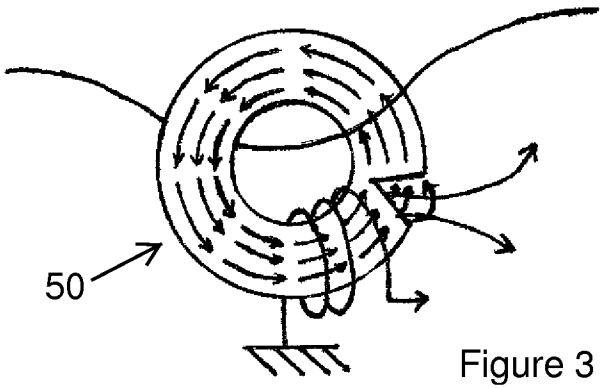
FIG. 3 illustrates a toroidal current transformer used in a valley fill ballast circuit with a gap extending approximately 75% of a toroid's core and the high current load shown in FIG. 2 and the 25% of solid saturated core.
Figure 3A:
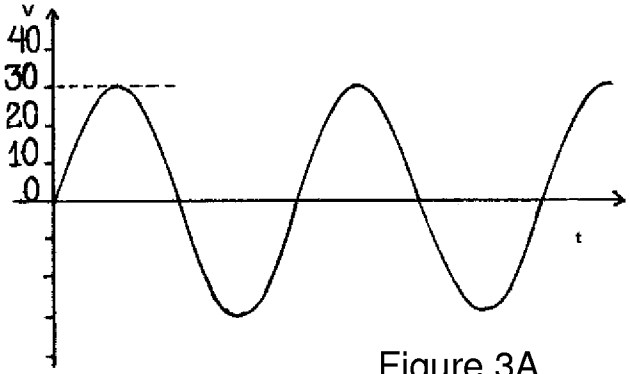
FIG. 3A is a Cartesian chart showing the resulting waveform for the voltage output of the secondary shown in FIG. 3.
Figure 4:
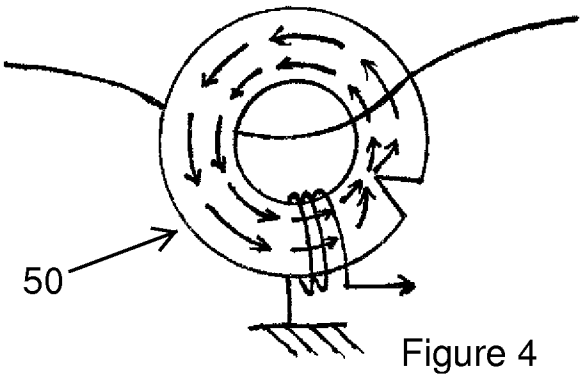
FIG. 4 is a representation of the same toroidal current transformer shown in FIG. 3 with a low load to current and non-saturated core.
Figure 4A:
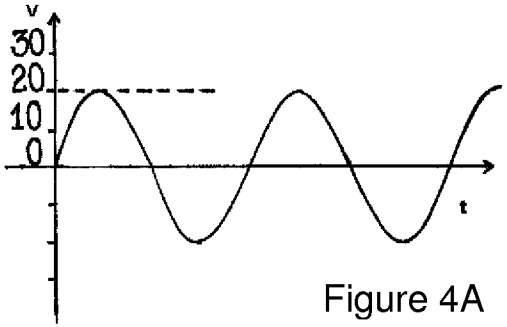
FIG. 4A is a Cartesian chart showing the resulting waveform for the voltage output of FIG. 4.

The current intensity through lamp load circuit L, however, varies abruptly at the initial ignition and during the operation of a typical ballast system using inexpensive rippled DC sources. The gates of transistors Q1 and Q2 require 12-15 volts to switch on and off. This establishes a minimum voltage requirement when the line voltage is at a valley. However, at certain times, with the current intensity variations anywhere from 7-10 times the minimum current, the voltage induced in the secondary windings can also be increased 7-10 times. FIGS. 2 and 2A represent the direct linear relationship between the load current and the secondary winding voltage in a conventional toroidal current transformer. This makes the use of voltage limiting components necessary and these components need to be rated to dissipate considerably large amounts of heat.

The present invention solves this problem by incorporating a cut in the core of the toroidal current transformer of cooperative dimensions so that the uncut portion is saturated when sufficient magnetic flux lines ($\phi$) pass that generate the necessary 12-15 volts in the secondary windings for the lowest load current the ballast will experience. FIG. 1 shows a gap with two opposite conveying surfaces to achieve the foregoing saturation characteristics.

Yet for higher intensities of the load current, the uncut portion is saturated and additional flux lines are forced to pass through the cut or gap with a considerably lower permeability. The result is a non-linear response to the variations of the intensity of the load current after a predetermined intensity magnitude. After this predetermined intensity, the relationship between the load current and the secondary windings' voltage is a logarithmic one with substantial attenuation.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. In an electrical ballast system having a rippled DC source driving a toroidal current transformer with a core having an exterior surface, a primary winding, and two secondary windings with said primary winding connected in series to a lamp load circuit conducting a current with varying amplitude and said secondary windings connected to two transistors' gate, the improvement comprising a semi gap in said core extending from said exterior surface a predetermined distance and said semi gap having two opposing surfaces that converge interiorly in said core wherein said semi gap defines two opposing surfaces in said core disposed at an angle with respect to each other that extends from 40 to 50 degrees defining a wedge-like reduced core area to limit the output voltage amplitude of said secondary winding to a predetermined voltage amplitude limit compatible with said transistor gates when said reduced core area is magnetically saturated, keeping a linear relationship between said current and said output voltage up to said limit, and keeping a non-linear relationship between said current and said output voltage after said limit so that said output voltage is attenuated sufficiently to minimize the use of power-limiting protective circuits and wasted energy.

2. The improvement set forth in claim 1 wherein said semi gap extends perpendicularly from said exterior surface a predetermined distance.

3. The improvement set forth in claim 2 wherein said semi gap defines two opposing surfaces in said core disposed at an angle with respect to each other of approximately 45 degrees.

4. The improvement set forth in claim 3 wherein said predetermined distance results in a semi gap that extends between 25% and 75% of the cross-sectional area of said core.

5. The improvement set forth in claim 4 wherein said semi gap extends over approximately 75% of the cross-sectional area of said core.

6. The improvement set forth in claim 5 wherein said semi gap defines two opposite converging surfaces meeting at said predetermined distance inside said core.

* * * * *